US008490712B2

(12) United States Patent
Genani et al.

(10) Patent No.: US 8,490,712 B2
(45) Date of Patent: Jul. 23, 2013

(54) PUSH FRAME WITH TAPERED CROSS-BEAM

(75) Inventors: Gaurav Genani, Maharashtra (IN); Steven J. Ditzler, Bellevue, IA (US)

(73) Assignee: Deere & Company, Moline, IL (US)

( * ) Notice: Subject to any disclaimer, the term of this patent is extended or adjusted under 35 U.S.C. 154(b) by 537 days.

(21) Appl. No.: 12/618,162

(22) Filed: Nov. 13, 2009

(65) Prior Publication Data

US 2011/0114343 A1 May 19, 2011

(51) Int. Cl.
*E02F 3/76* (2006.01)

(52) U.S. Cl.
USPC ..... 172/811

(58) Field of Classification Search
USPC .... 172/826, 810, 811, 816, 817, 828; 37/231, 37/234, 272, 279, 266, 268; 414/723, 727
See application file for complete search history.

(56) References Cited

U.S. PATENT DOCUMENTS

| | | | | |
|---|---|---|---|---|
| 1,745,540 | A | 2/1930 | Isbell | |
| 2,341,853 | A * | 2/1944 | Ellsworth | 172/831 |
| 2,636,289 | A * | 4/1953 | Pryor | 172/821 |
| 3,049,821 | A * | 8/1962 | Lichti | 172/826 |
| 3,631,931 | A * | 1/1972 | Frisbee | 172/821 |
| 3,653,450 | A * | 4/1972 | Rockwell et al. | 172/826 |
| 3,662,841 | A * | 5/1972 | Molby et al. | 172/824 |
| 4,031,968 | A | 6/1977 | Krolak et al. | |
| 4,135,584 | A | 1/1979 | Smith et al. | |
| 4,151,887 | A | 5/1979 | Freese | |
| 4,153,117 | A | 5/1979 | Freese | |
| 6,041,871 | A * | 3/2000 | Defty | 172/817 |
| 6,273,198 | B1 | 8/2001 | Bauer et al. | |
| 6,607,256 | B2 | 8/2003 | Yoshida et al. | |
| 7,293,374 | B2 * | 11/2007 | Fukushima | 37/397 |
| 7,690,441 | B2 | 4/2010 | Matsumoto et al. | |

OTHER PUBLICATIONS

Background Information (1 page) (prior art).
Deere 750J 850J Crawler Dozer Brochure (May 2007) (24 pages).
Deere 850J Dozer Push Frame (2 pages) (prior art).
Deere 850J Waste Handler Brochure (16 pages) (Apr. 2007).
Deere 950J 1050J Crawler Dozers Brochure (20 pages) (Apr. 2007).
Deere 950J 1050J Waste Handlers Brochure (Apr. 2007) (20 pages).
Views of Deere Push Frame (2 pages) (Prior Art).
Additional Background Information (1 page) (prior art).

* cited by examiner

*Primary Examiner* — Matthew D Troutman

(57) ABSTRACT

A push frame is provided for interconnecting an undercarriage of a tractor of a work vehicle and a blade of the work vehicle. The push frame comprises a first push-beam, a second push-beam, a first cross-beam, a second cross-beam, and a center joint. The first and second push-beams are spaced apart to be positioned on laterally opposite sides of the undercarriage relative to a fore-aft axis of the push frame. The first and second cross-beams are fixed respectively to the first and second push-beams laterally outwardly relative to the fore-aft axis and are attached to one another laterally inwardly relative to the fore-aft axis by the center joint of the push frame allowing relative movement between the first and second cross-beams. At least one of the first and second cross-beams varies in height.

14 Claims, 6 Drawing Sheets

PUSH FRAME WITH TAPERED CROSS-BEAM

FIELD OF THE DISCLOSURE

The present disclosure relates to a push frame for use with, for example, a blade of a crawler dozer.

BACKGROUND OF THE DISCLOSURE

There are crawler dozers that are provided for use in heavy duty applications and have a tractor, a blade, and a push frame interconnecting the tractor and the blade. The blade is provided for pushing large quantities of soil, sand, rubble, or other material, earthen or otherwise.

The push frame has a pair of push-beams and a pair of cross-beams. The push-beams are attached pivotally to the tractor so as to be positioned laterally outwardly from the undercarriage on either side thereof and are attached pivotally to the blade. The cross-beams are fixed respectively to the push-beams laterally outwardly relative to a fore-aft axis and attached to one another laterally inwardly relative to the fore-aft axis by a center joint, linked to the blade, allowing relative movement between the cross-beams.

SUMMARY OF THE DISCLOSURE

According to an aspect of the present disclosure, there is provided a push frame for interconnecting an undercarriage of a tractor of a work vehicle and a blade of the work vehicle. The push frame comprises a first push-beam, a second push-beam, a first cross-beam, a second cross-beam, and a center joint. The first and second push-beams are spaced apart to be positioned on laterally opposite sides of the undercarriage relative to a fore-aft axis of the push frame. The first and second cross-beams are fixed respectively to the first and second push-beams laterally outwardly relative to the fore-aft axis and are attached to one another laterally inwardly relative to the fore-aft axis by the center joint of the push frame allowing relative movement between the first and second cross-beams. At least one of the first and second cross-beams varies in height, promoting, for example, operator visibility of the bottom, cutting region of the blade and/or ground clearance for incremental cutting depth of the blade.

Each of the first and second cross-beams may taper in height as that cross-beam extends along its width away from a tractor side of that cross-beam toward a blade side of that cross-beam. A top wall of that cross-beam may slope toward a bottom wall of that cross-beam along the width of that cross-beam, starting at a bend or inflection point in the top wall. Such taper in height along the width promotes operator visibility of the cutting region of the blade through laterally outward observation zones between the cross-beams and the cutting region.

Each of the first and second cross-beams may taper in height as that cross-beam extends along its length laterally inwardly relative to the fore-aft axis. The top and bottom walls of each of the first and second cross-beams may slope relative to the push-beam to which that cross-beam is fixed toward one another as they extend laterally inwardly relative to the fore-aft axis. In so doing, the top wall may slope downwardly, promoting shedding of material laterally inwardly away from the observation zones, and the bottom wall may slope upwardly, enhancing ground clearance of the center joint.

The above and other features will become apparent from the following description and the attached drawings (hoses and welds not shown in drawings, but to be understood).

BRIEF DESCRIPTION OF THE DRAWINGS

The detailed description of the drawing refers to the accompanying figures in which.

DETAILED DESCRIPTION OF THE DRAWINGS

Figure 1:
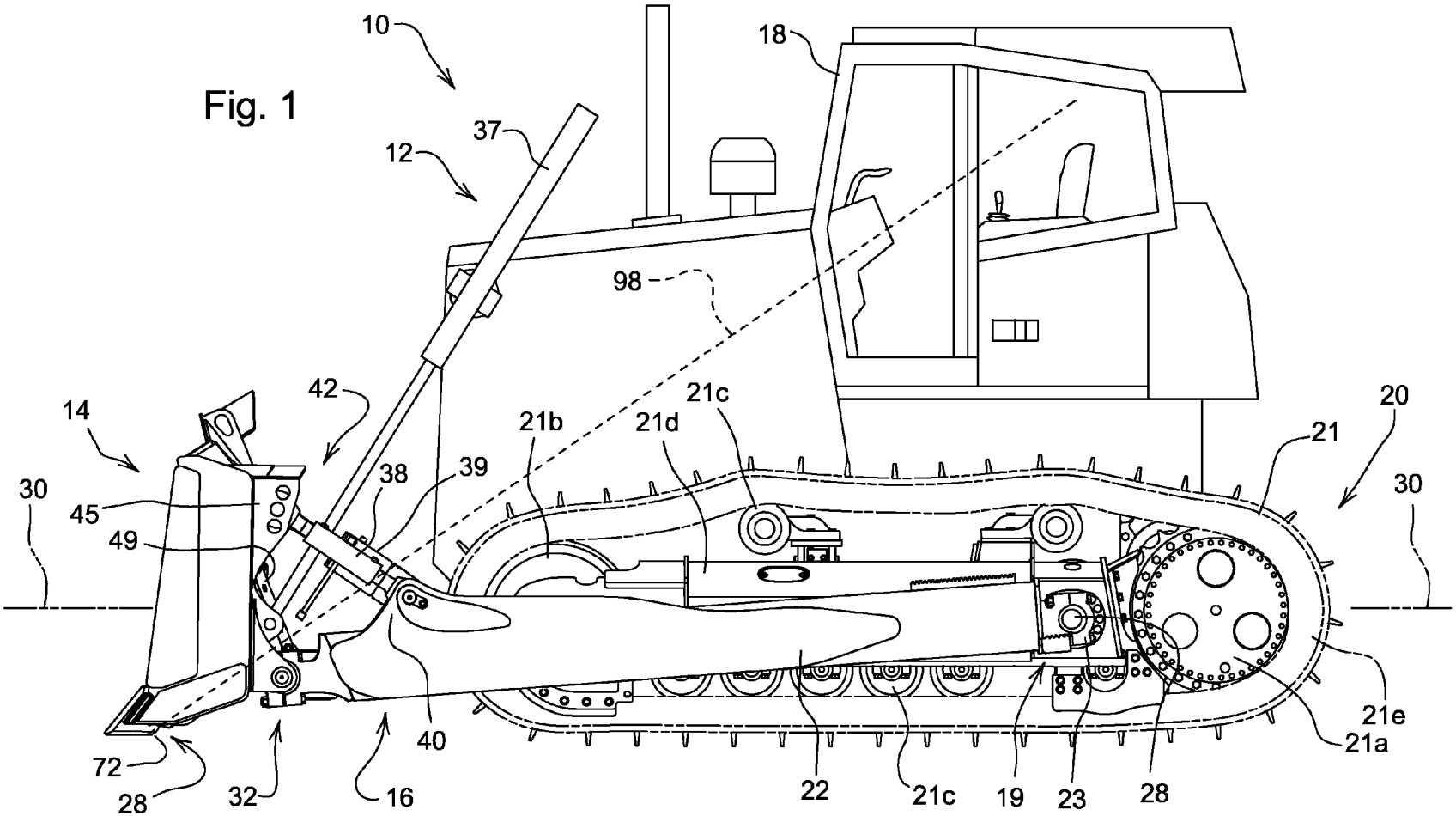
FIG. 1 is a side elevation view of a work vehicle in the form of, for example, a crawler dozer having a push frame interconnecting a tractor and a blade.

Referring to FIG. 1, there is shown a work vehicle 10 exemplarily configured as a crawler dozer. The vehicle 10 includes a tractor 12, a blade 14, and a push frame 16 interconnecting the tractor 12 and the blade 14. The blade 14 is configured to push large quantities of soil, sand, rubble, or other material, earthen or otherwise. The tractor 12 includes an operator's station 18 from which a human operator can control the vehicle 10 and a tracked undercarriage 20 configured to propel the vehicle 10.

The undercarriage 20 has left and right track assemblies positioned on laterally opposite sides of the tractor 12 for propulsion of the vehicle 10, the left track assembly shown in FIG. 1 in simplified form at 21. Each track assembly 21 has a rear drive sprocket 21 a rotatably attached to a main frame of the tractor 12 (the teeth of the sprocket 21*a* may be included in circumferential segments (e.g., five such segments) aligned circumferentially about the sprocket 21*a*), a front idler 21*b*, upper and lower rollers 21*c* rotatably attached to a track frame 21*d* of the track assembly 21, and a track 21*e* shown diagrammatically and trained about the drive sprocket 21*a*, the idler 21*b*, and the rollers 21*c*. The track 21*e* has a closed-loop chain, having two rows of interconnected links, and ground-engaging shoes mounted to the chain thereabout for engagement with the ground. A track chain tension adjuster is mounted to the track frame 21*d* and is attached to the idler 21*b*, movable a distance fore-and-aft relative to the track frame 21*d*, to press the idler 21*b* against the chain to tension the track 21*e*. The undercarriage 20 may take any suitable form such as a conventional undercarriage.

Figure 2:
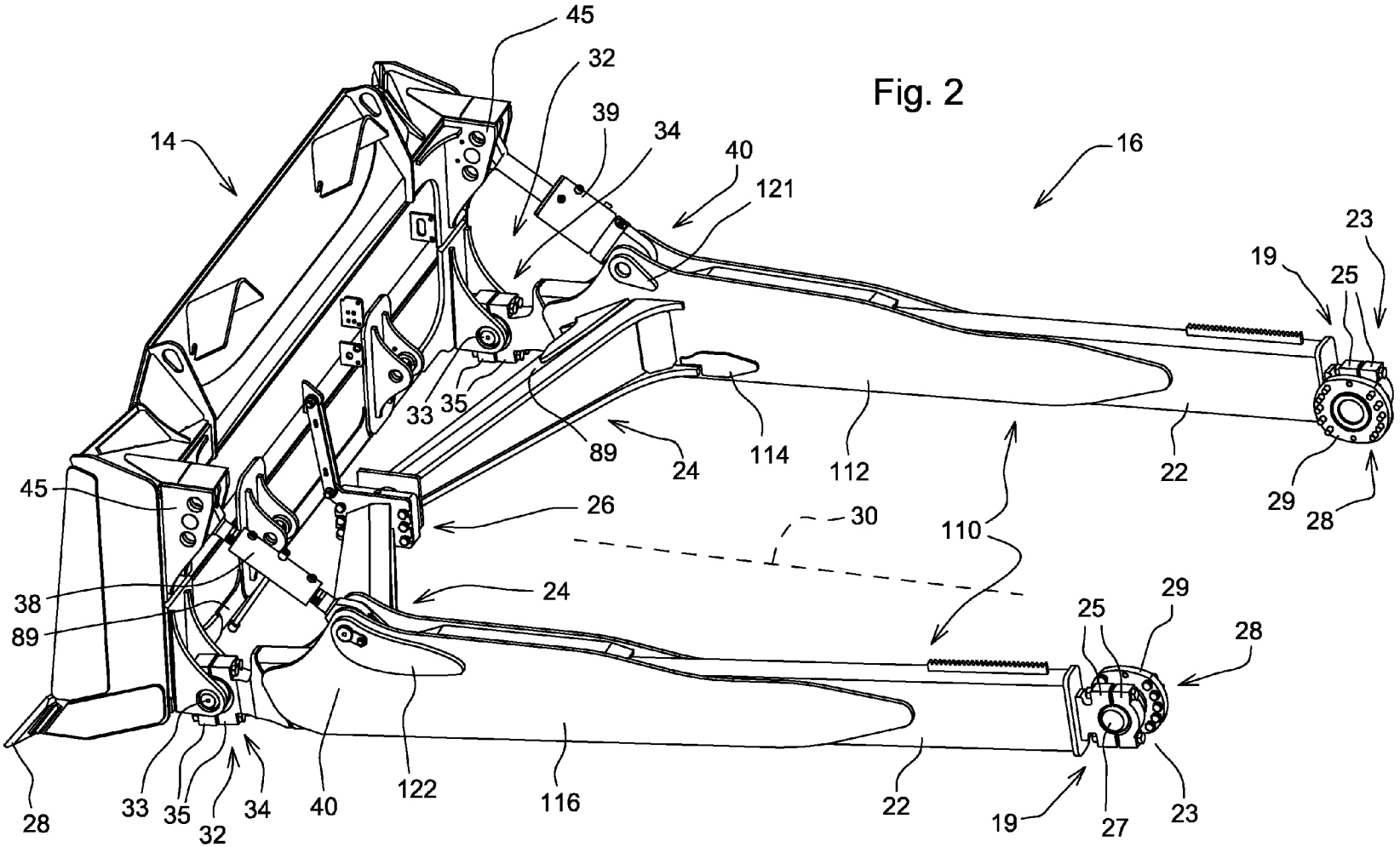
FIG. 2 is a perspective view showing the push frame attached to the blade.

Referring to FIG. 2, the push frame 16 includes a pair of push-beams 22, a pair of cross-beams 24, and a center joint 26 interconnecting the cross-beams 24 allowing relative movement therebetween. The cross-beams 24 and the center joint 26 cooperate to provide a cross-beam assembly that aids in the stability of the push frame 16. The cross-beam assembly is configured to promote ground clearance of the cross-beam assembly and, thus, an incremental cutting depth of the blade 14 and to promote operator visibility of the bottom, cutting region 28 of the blade 14 from the operator's station 18.

The push frame 16 is attached pivotally to the tractor 12 and the blade 14 therebetween. The push-beams 22 are attached pivotally to and positioned laterally outward from the undercarriage 20 using a pair of rearward pivot couplings 19. As such, the push-beams 22 are positioned on laterally opposite sides of the undercarriage 20 relative to a fore-aft axis 30 of the frame 16 and the vehicle 10. The push-beams 22 are attached pivotally to the blade 14 using a pair of forward pivot couplings 32. The push-beams 22 may be attached pivotally to the undercarriage 20 and the blade 14 in any suitable manner, such as a conventional manner.

Exemplarily, each rearward pivot coupling 19 may include a clamp 23 and a trunnion 28. The clamp 23 may have a pair of C-shaped jaws or caps 25. A first of the jaws 25 may be welded to a plate of the clamp 23 welded to the rearward end of a respective push-beam 22. The first jaw 25 may have a slightly larger inner diameter than a second of the jaws 25 so as to receive a half-moon bushing of the clamp 23 therein. A ball 27 of the trunnion 28 may be received in the clamp 23 between the jaws 25 with the half-moon bushing positioned between the ball 27 and the first jaw 25. The second jaw 25 may be bolted to the first jaw 25 using a threaded top bolt of the clamp 23 and a threaded bottom bolt of the clamp 23. The jaws 25 may be shimmed as needed using one or more upper shims of the clamp 23 and one or more lower shims of the clamp 23, the shims being positioned between the first and second jaws 25 and perforated to receive the respective bolt therethrough. The ball 27 may be welded to a mounting plate 29 of the trunnion 28 bolted to the respective track frame (mounting plate bolts are shown in simplified form without threads, threads being understood).

Exemplarily, each forward pivot coupling 32 may include a ball 33 and a clamp 34 clamping the ball 33. The clamp 34 may have a pair of C-shaped jaws or caps 35. A first of the jaws 35 may be included in a casting welded in place at a forward end of a respective push-beam 22. The first jaw 35 may have a slightly larger inner diameter than a second of the jaws 35 so as to receive a half-moon bushing of the clamp 34 therein. A spherical portion of the ball 33 may be received in the clamp 34 between the jaws 35 with the half-moon bushing positioned between the ball 33 and the first jaw 35. The second jaw 35 may be bolted to the first jaw 35 using a pair of threaded top bolts of the clamp 34 and a pair of threaded bottom bolts of the clamp 34. The jaws 35 may be shimmed as needed using one or more upper shims of the clamp 34 and one or more lower shims of the clamp 34, the shims being positioned between the first and second jaws 35 and perforated to receive the respective bolts therethrough. The ball 33 may have opposite, protruding end portions received in and welded to the respective holes of two ears of a clevis bracket 36 mounted to the rear of the blade 14.

A pair of trunnion-mounted hydraulic lift cylinders 37, the left lift cylinder of which is shown, for example, in FIG. 1, is attached pivotally to the tractor 12 and to the blade 14 using a pair of pivot couplings in, for example, a conventional manner or any other suitable manner. Exemplarily, the cylinders 37 are mounted to either side of the tractor 12 and to the rear of the blade 14 using respective pivot couplings. The operator can raise and lower the blade 14 relative to the tractor 12 using the lift cylinders 37.

The vehicle 10 has a first or pitch link 38 and a second or tilt link 39. Exemplarily, each link 38, 39 has an adjustable length, and is attached pivotally to a respective push-beam 22 and to an upper portion of the rear of the blade 14 next to an end of the blade 14.

The pitch link 38 is, for example, a turnbuckle having externally threaded opposite ends and an internally threaded sleeve threaded thereto (the external threads of the turnbuckle ends shown diagrammatically and having a thread specification of, for example, M60×3, where the "60" and the "3" represent the major diameter and pitch, respectively, both in millimeters). The external threads of the turnbuckle ends may illustratively be partially exposed outside the turnbuckle sleeve, or, in other embodiments, may be completely hidden within the sleeve to minimize exposure to debris. As such, the length of the pitch link 38 can be adjusted mechanically to change the pitch of the blade 14 relative to the frame 16. Alternatively, the pitch link 38 may be a fixed-length link.

The tilt link 39 is, for example, a hydraulic cylinder (not shown are the extend hose and the retract hose). As such, the length of the tilt link 39 can be adjusted hydraulically, such as by the operator from the operator's station 18, to change the tilt angle of the blade 14 relative to the axis 30 of the vehicle 10. A shield (not shown) may be mounted to the tilt link 39 to protect the hydraulic hoses for the tilt link 39 from damage.

Figure 3:
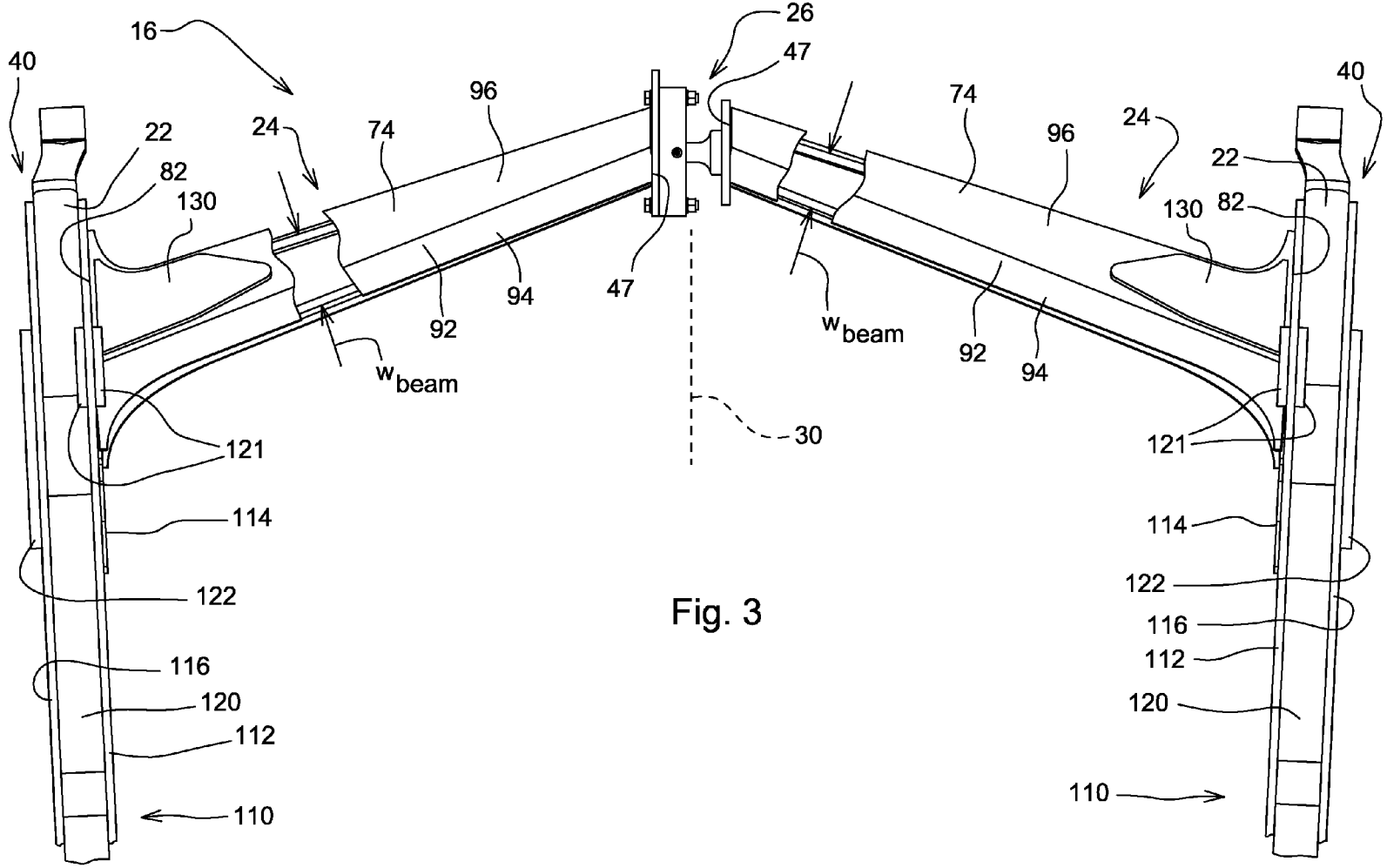
FIG. 3 is a top plan view of the cross-beam assembly.

Referring to FIGS. 2 and 3, each push-beam 22 is included in a leg 110 (which may be referred to as a push-leg). Each push-leg 110 may further include the clamp 23 of the respective rearward pivot coupling 19, the clamp 34 of the respective forward pivot coupling 32, and a number of plates.

The plates may include a laterally inward main reinforcement plate 112 fixed (e.g., welded) to a laterally inward wall of the push-beam 22, a laterally inward smaller reinforcement plate 114 fixed (e.g., welded) to a laterally inward surface of the laterally inward main reinforcement plate 112 as well as a bottom wall 76 and a rear gusset 86, a laterally outward main reinforcement plate 116 fixed (e.g., welded) to a laterally outward wall of the push-beam 22, a number of bosses fixed to upwardly projecting portions of the main reinforcement plates 112, 116, and a cover plate 120 positioned between the main reinforcement plates 112, 116 and fixed (e.g., welded) to the main reinforcement plates 112, 116 and to the push-beam 22 (the weld extending along the bottom edge of the plate 114 may continue forward to an imaginary vertical line defined by a rearward vertical edge of a rear gusset 86 and then taper in to weld between bottom edge of plate 112 and push-beam 22). The reinforcement plates 112, 114, 116 strengthen the push-beam 22, and may be referred to as doubler plates. The cover plate 120 is positioned to prevent excessive accumulation of mud or other debris in the gap between the main reinforcement plates 112, 116 above the push-beam 22, and also strengthens the push-leg 110.

The bosses may include a pair of laterally inward smaller bosses 121 and a laterally outward larger boss 122. The smaller bosses 120 may be configured the same as one another and fixed (e.g., welded) respectively to laterally opposite surfaces of an upwardly projecting portion of the laterally inward main reinforcement plate 112 such that the smaller bosses 120 and that upwardly projecting portion cooperate to provide a first ear. The larger boss 122 may be fixed (e.g., welded) to a laterally outward surface of an upwardly projecting portion of the laterally outward main reinforcement plate 116 such that the larger boss 122 and that upwardly projecting portion cooperate to provide a second ear. Such first and second ears cooperate to provide a clevis bracket of a respective link anchor 40.

The frame end of each link 38, 39 is attached pivotally to a respective push-beam 22 using a link anchor 40. Exemplarily, each link anchor 40 may include the clevis bracket, a pin, and a pin retainer. The pin extends within a pair of through-holes formed in the ears of the clevis bracket and through a through-hole in a spherical plain bearing of the frame end of the respective link 38, 39 (such bearing may also be referred to as a spherical bushing) (bearing retained in place using, for example, two circlips positioned on opposite sides of the bearing) and a bushing positioned on either side of the frame end of that link 38, 39. The frame end and pin may be lubricated with lubricant (e.g., grease) via a lubrication fitting. The pin is retained in place by the pin retainer configured, for example, as a bolt and a retaining plate bolted to the second ear of the clevis bracket using the bolt and received in an annular groove of the pin. It is to be understood that the links 38, 39 may be attached pivotally to a respective push-beam 22 in any suitable manner.

The blade ends of the pitch and tilt links 38, 39 are attached pivotally respectively to link anchors 45. The anchors 45 are mounted to the upper portion of the rear of the blade 14 next to the ends of the blade 14. Each link anchor 45 may include a clevis bracket, a pin, and a pin retainer. The clevis bracket may include a pair of ears, each ear including a main plate and a boss fixed (e.g., welded) to a surface facing the main plate of the other ear. The pin extends within a pair of through-holes formed in the ears of the clevis bracket and through a through-hole in a spherical plain bearing of the blade end of the respective link 38, 39 (such bearing may also be referred to as a spherical bushing) (bearing retained in place using, for example, two circlips positioned on opposite sides of the bearing) and a bushing positioned on either side of the blade end of that link 38, 39. The blade end and pin may be lubricated with lubricant (e.g., grease) via a lubrication fitting. The pin is retained in place by the pin retainer configured, for example, as a bolt and a retaining plate bolted to the laterally inward ear of the clevis bracket using the bolt and received in an annular groove of the pin. It is to be understood that the links 38, 39 may be attached pivotally to the blade 14 in any suitable manner.

The mounting points of the anchors 45 may be arranged in pairs of mounting points, one from the pitch link anchor and one from the tilt link anchor, such that each pair of mounting points corresponds to a respective pitch of the blade 14 relative to the frame 16. As such, the frame ends of the pitch and tilt links 38, 39 may be pivotally attached to the push-frame 16 and the blade ends of the pitch and tilt links 38, 39 may be pivotally attached respectively to the mounting points of a selected one of the pairs of mounting points to establish the blade 14 at the pitch corresponding to that pair of mounting points. The pitch of the blade 14 may be adjusted by changing to which pair of mounting points the links 38, 39 are pivotally attached respectively. As alluded to above, the pitch link 38 may have a fixed length or may have an adjustable length (as with a turnbuckle). Length adjustability of the pitch link 38 may be useful to compensate for manufacturing tolerance stack-up (e.g., variation in cylinder stroke and close lengths of tilt cylinder 39) so as to fine-tune the system, and may be useful to provide even more fine pitch adjustment of the blade 14.

Figure 4:
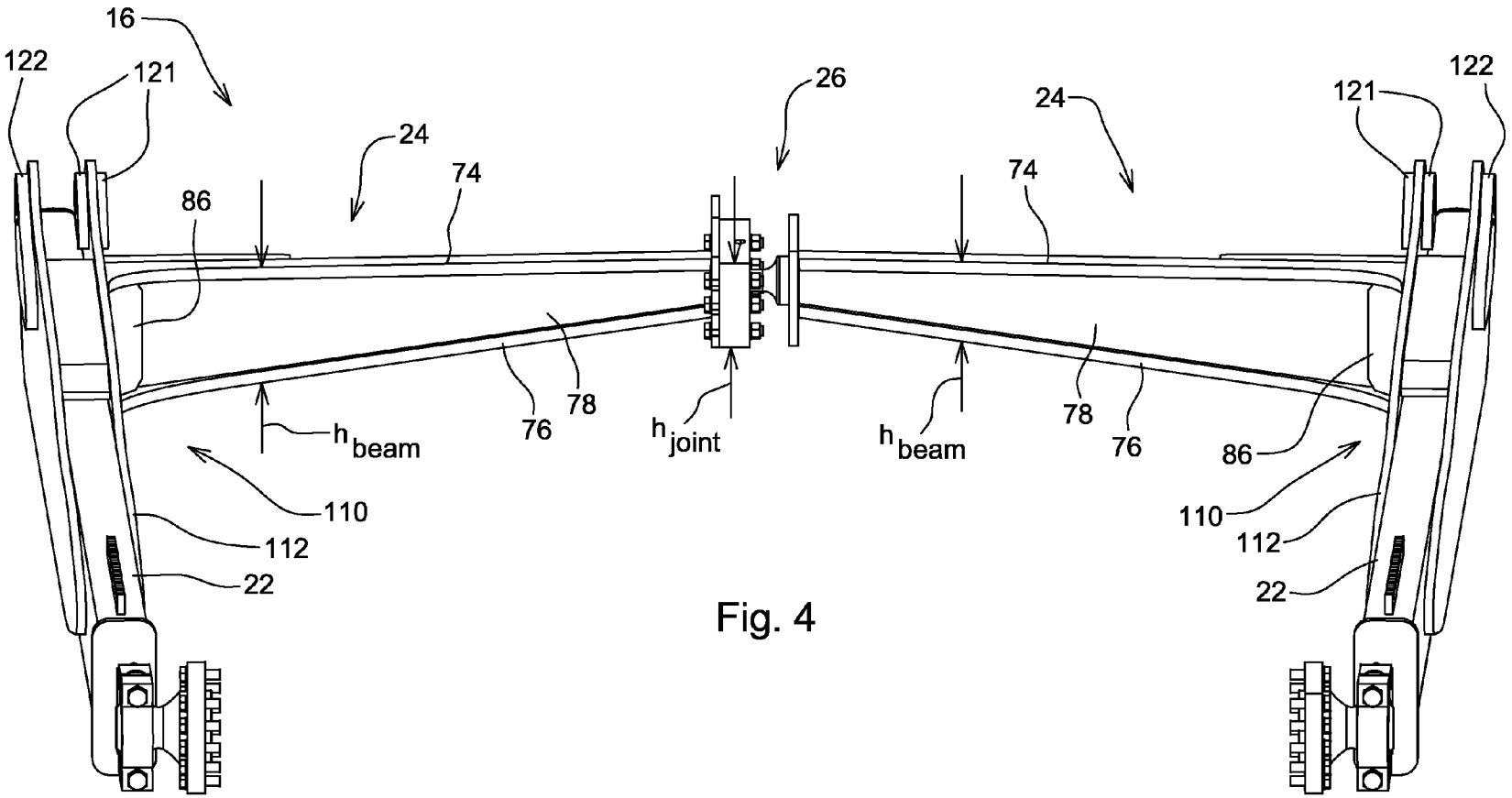
FIG. 4 is a rear elevation view of a cross-beam assembly of the push frame.
Figure 5:
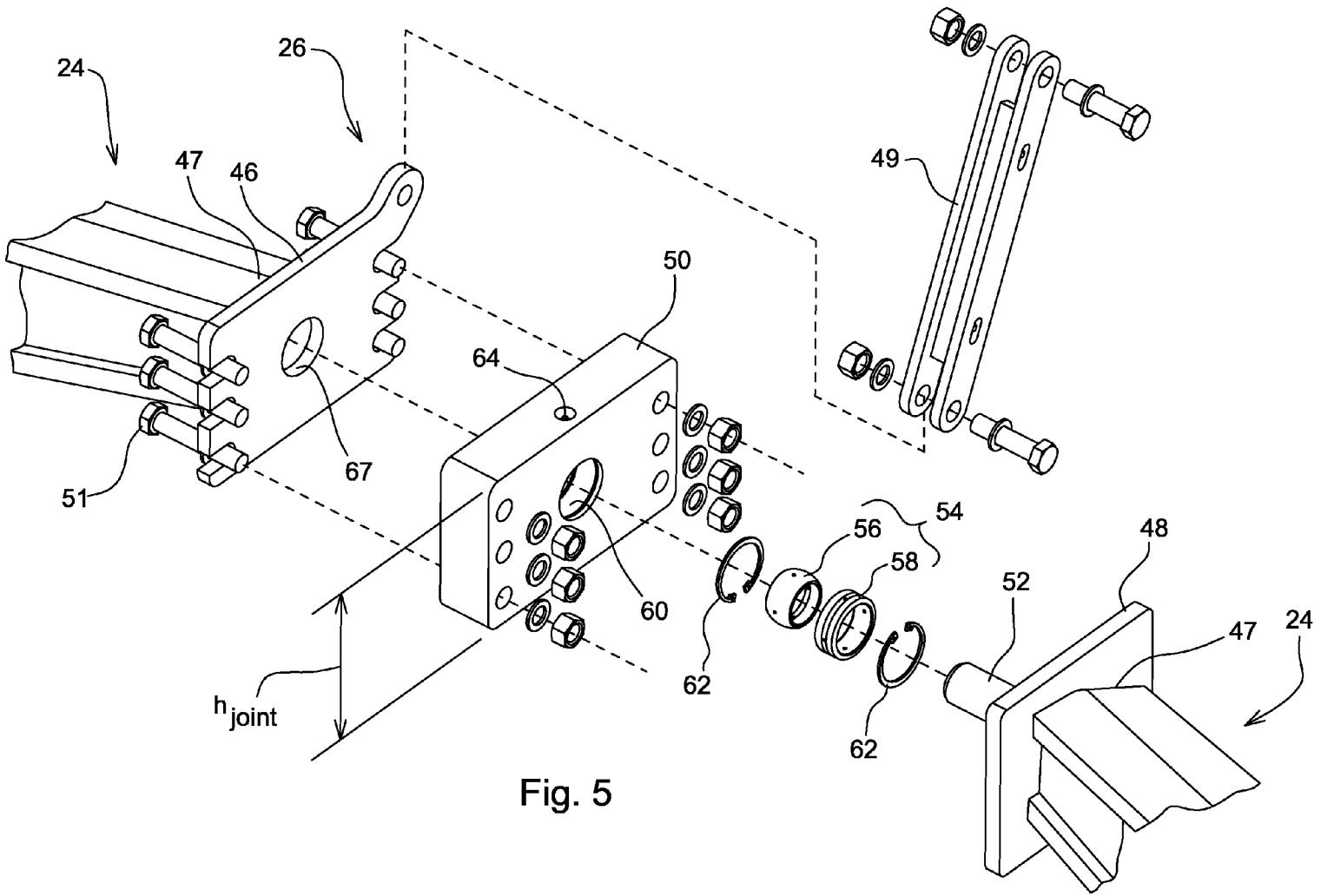
FIG. 5 is an exploded perspective view showing a center joint of the cross-beam assembly.

Referring to FIGS. 4 and 5, the center joint 26 is configured to allow rotational movement between the cross-beams 24 and allow movement of the cross-beams 24 toward and away from one another. The center joint 26 includes a left plate 46 welded to a laterally inward end 47 of the left cross-beam 24, a right plate 48 welded to the laterally inward end 47 of the right cross-beam 24, a housing 50 bolted to the left plate 46 with a number of threaded bolts 51 (e.g., six bolts—three toward the front of the housing 50 and three toward the rear of the housing 50 and bolts are shown in simplified form without threads, threads being understood), a pin 52, and a spherical plain bearing 54 (such bearing may also be referred to as a spherical bushing) mounted within a bearing hole 60 of the housing 50 and receiving the pin 52 such that the pin 52 is movable linearly along its length within the bearing 54. A link 49 is attached pivotally to the center portion of the blade 14 with a threaded bolt and to a corner tang 55 of the left plate 46 with a threaded bolt (such bolts are shown in simplified form without threads, threads being understood.

The bearing 54 may include an annular spherical bushing or inner race 56 and an annular bushing cover or outer race 58 positioned within the housing 50 and receiving the bushing 56. Two retaining rings 62, each configured, for example, as a circlip, may be installed on opposite sides of the bearing 54 to retain the bearing 54 in place in the bearing hole 60.

Lubrication (e.g., grease) may be injected into the bearing hole 60 via a lubricant fitting positioned in a lubrication hole 64 in communication with the bearing hole 60. The cover 58 may have an annular groove formed in its outer diameter surface and a number of through-holes (e.g., four) extending radially between that groove and its inner diameter surface for lubrication of the interface between the cover 58 and the bushing 56. The bushing 56 may have a number of through-holes (e.g., four) extending radially between the outer diameter surface of the bushing 56 and an annular groove formed in its inner diameter surface for lubrication of the interface between the bushing 56 and the pin 52. The pin 52 may be received in the bushing 56 for movement in a through-hole of the bushing 56 and a plate hole 67 formed in the plate 46 therethrough and in register with the bearing hole 60.

The center joint 26 is thus configured to allow rotational movement between the cross-beams 24 by virtue of the bearing 54 and allow movement of the cross-beams 24 toward and away from one another by virtue of the capacity of the pin 52 to move along its length relative to the bearing 54. It is to be understood that the center joint 26 may be configured in any suitable manner.

Figure 6:
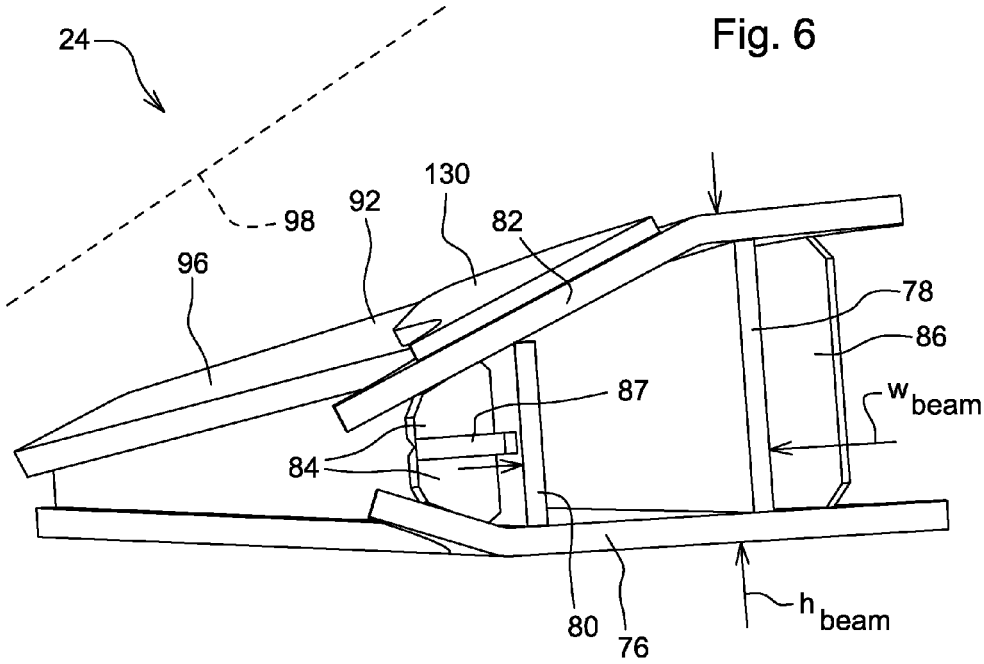
FIG. 6 is an end view of a laterally outward end of a left cross-beam of the cross-beam assembly.
Figure 7:
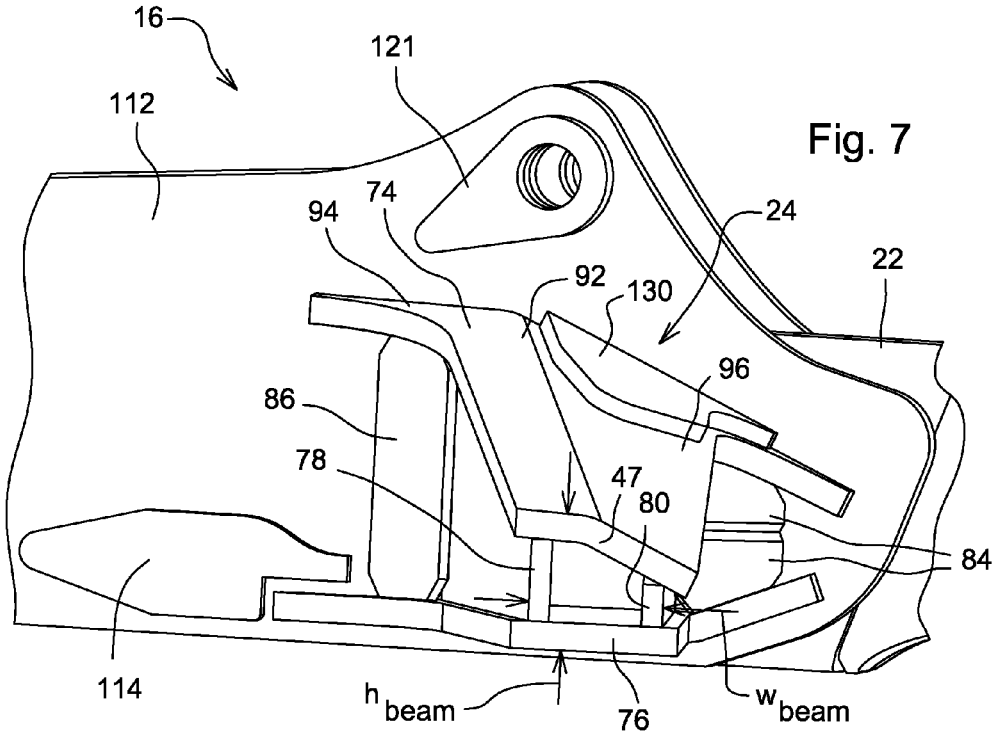
FIG. 7 is an end view of a laterally inward end of the left cross-beam.

Referring to FIGS. 6 and 7, each cross-beam 24 includes a top wall 74, a bottom wall 76, a tractor-side wall 78, and a blade-side wall 80. The top and bottom walls 74, 76 interconnect and are fixed (e.g., welded) to the tractor- and blade-side walls 78, 80 such that the cross-beam 24 is tubular. Exemplarily, the walls 74, 76, 78, 80 are configured, for example, as distinct plates arranged to form the respective cross-beam 24 and are fixed (e.g., welded) to the respective laterally inward main reinforcement plate 112 so as to be fixed to the push-beam 22 of the respective push-leg 110 at the laterally outward end 82 of the cross-beam 24 (a forward portion of the laterally outward end of the bottom plate 76 flares upwardly for welding purposes, e.g., to provide a cleaner weld away from a relatively high stress area) and to the respective plate 46 or 48 at the laterally inward end 47 of the cross-beam 24.

Larger stresses are observed at the laterally outward end 82 of the cross-beam 24 than at the laterally inward end 47. As such, the cross-sectional area of the cross-beam 24 is larger at the laterally outward end 82 than at the laterally inward end 47. Thus, there is a relatively wide section at the joint between the cross-beam 24 and the respective push-beam 22, providing enhanced strength in that constrained space. As a result, gusseting at the laterally outward end 82 is reduced to a great extent.

Conversely, since relatively low stresses are observed in the central area of the cross-beam assembly, the central area of the cross-beam assembly has been reduced in size, reducing material of the cross-beam assembly in that area. The cross-sectional area of the laterally inward end 47 of the cross-beam 24 need not be as large as at the laterally outward end 82. The cross-sectional area of the cross-beam 24 is thus smaller at its laterally inward end 47 than at its laterally outward end 82.

With respect to each cross-beam 24, two front gussets 84, one positioned above the other, are fixed (e.g., welded) to the top, bottom, and blade-side walls 74, 76, 80 and to one another, and a rear gusset 86 is fixed (e.g., welded) to the top, bottom, and tractor-side walls 74, 76, 78. The front gussets 84 are chamfered to define therebetween a weld groove to a receive weld. The gussets 84, 86 reinforce the mounting of the cross-beams 24 at their laterally outward ends 82. A gusset 87 (FIG. 6) reinforces the front gussets 84 at the interface therebetween. The gusset 87 is fixed (e.g., welded) to the front gussets 84 at their interface, the wall 80 and plate 112.

Referring to FIGS. 1 and 4, during a digging operation, the blade 18 may cut generally in steps until it reaches its maximum digging depth. The depth of cut of each step may be limited by the lowest point(s) of the push frame 16 which may contact and drag against the ground during a cut. For example, when the blade 14 makes a first cut, it can go to a depth defined by the vertical distance between a cutting edge 72 of the cutting region 28 and the lowest point(s) of the push frame 16 (such depth may be referred to as the incremental cutting depth). The blade 18 will remain generally at that depth until the lowest point(s) is exposed to the hole just cut by the blade 18. The blade 18 will then proceed to make a second cut having the defined incremental cutting depth. The blade 18 may continue to cut in such a stepped manner until it reaches its maximum digging depth.

The center joint 26 is a potential drag point, in particular the front bottom corner of the housing 50 of the center joint 26. The forward couplings 32 are two other potential drag points. In view of the relatively low stresses in the central area of the cross-beam assembly, the height ($h_{joint}$) of the center joint 26 (FIGS. 4 and 5) has been minimized so as to raise the bottom of the center joint 26 in order to promote maximization of the incremental cutting depth. Minimization of the height ($h_{joint}$) is limited, for example, by spacing between bolt holes 68 for the bolts 51 (e.g., spacing is 1.5×the diameter of the bolt holes 68). Minimization of the height ($h_{joint}$) of the center joint 26 raises the lowest point of the center joint 26, maximizing the ground clearance of the center joint 26 and thus promoting maximization of the incremental cutting depth so as to promote minimization of the number of steps to reach the maximum digging depth, promoting operational efficiency. In the illustrated embodiment, the forward couplings 32 are lower than the center joint 32 (the forward couplings 32 sized for stress management) and thus become the limiting factor with respect to the incremental cutting depth. In other examples, the lowest points of the center joint 26 and the forward couplings 32 may be at the same level, or the forward couplings 32 may be higher than the center joint 26, to enhance the incremental cutting depth even further.

A parameter associated with the incremental cutting depth may be referred to as an angle of attack, i.e., the angle between horizontal and an imaginary line connecting the cutting edge 72 and the lowest point of the center joint 26 along a longitudinal axis of the push frame 16 and vehicle 10 (this imaginary line is the hypotenuse of a right triangle having horizontal as its base and the incremental cutting depth as its vertical side). For a given pitch of the blade 18, minimization of the joint height ($h_{joint}$) due to raising of the bottom of the center joint 26 promotes maximization of such angle of attack.

Referring to FIG. 4, the cross-beam 24 tapers in height ($h_{beam}$) as it extends along its length laterally inwardly relative to the axis 30. The height ($h_{beam}$) is smaller at the laterally inward end 47, where stresses are smaller, than at the laterally outward end 82, where stresses are larger. The top and bottom walls 74, 76 slope relative to the push-beam 22 to which the respective cross-beam 24 is fixed toward one another as they extend laterally inwardly relative to the axis 30.

The bottom wall 76 slopes upwardly from the laterally outward end 82 to the laterally inward end 47 at an angle of, for example, 0.7 degrees relative to a normal of the respective laterally inward main reinforcement plate 112. Such upward sloping of the bottom wall 76 promotes the ground clearance of the cross-beam 24 and thus center joint 26.

The top wall 74 slopes downwardly from the laterally outward end 82 to the laterally inward end 47 at an angle of, for example, 6.5 degrees relative to a normal of the respective laterally inward main reinforcement plate 112. Such downward sloping of the top wall 74 promotes shedding of material laterally inwardly toward the axis 30 away from a respective observation zone 89 (FIG. 1) defined between each cross-beam 24 and the cutting region 28 (there are thus two such observation zones 89, one on each side of the push frame 16), rather than collection of material laterally outwardly, as material flows over the top of the cross-beam 24 during operation of the vehicle 10, promoting operator visibility of the cutting region 28 of the blade 14 along an operator's line of sight from the operator's seat in the operator's station 18 through the respective observation zone 89. Further, such downward sloping of the top wall 74 promotes maximization of the size of the respective observation zone 89 and thus operator visibility of the cutting region 28 through the respective observation zone 89.

Referring to FIGS. 6 and 7, to promote such operator visibility even further, the cross-beam 24 is tapered in height ($h_{beam}$) as it extends along its width away from a tractor side of the cross-beam 24 toward a blade side of the cross-beam 24. More particularly, the cross-beam 24 is tapered in height ($h_{beam}$) as it extends along its width away from the tractor-side wall 78 toward the blade-side wall 80. Such taper in height ($h_{beam}$) along the width promotes maximization of the size of the respective observation zone 89 and thus operator visibility of the cutting region 28 through the respective observation zone 89.

The top wall 74 slopes toward the bottom wall 76 as the top wall 74 extends along the width of the cross-beam 24, starting at a bend or inflection point 92 in the top wall 74. As such, the top wall 74 has a first section 94 attached to (e.g., welded) and extending from the tractor-side wall 78 of the cross-beam 24, a second section 96 attached to (e.g., welded) and extending from the blade-side wall 80 of the cross-beam 24. The bend 92 between the first and second sections 94, 96 is configured such that the second section 96 slopes relative to the first section 94 toward the blade-side wall 80 at, for example, an angle of 30 degrees from a normal of the first section 94. The cross-beam 24 thus has a non-rectangular cross-section.

A reinforcement plate 130 is fixed (e.g., welded) to the top of the second section 96 of each top wall 74 and the adjacent reinforcement plate 112. The reinforcement plate 130 strengthens that section 96, and may be referred to as a doubler plate.

Referring to FIGS. 1 and 6, the section 96 may thus be angled to promote operator visibility through the respective observation zone 89. Exemplarily, the section 96 may be about parallel to a line of sight 98 of the operator from the operator's station to the cutting region 28. In some embodiments, the section 96 may be angled somewhat more than the line of sight 98 to accommodate potential material build-up on the cross-beam 26.

Referring to FIG. 3, due to larger stresses laterally outwardly and smaller stresses laterally inwardly, the cross-beam 24 tapers in width as it extends along its length laterally inwardly relative to the axis 30. The tractor-side wall 78 and the blade-side wall 80 extend toward one another as they extend along the length of the cross-beam 24 laterally inwardly relative to the axis 30. Such tapering in width of the cross-beam 24 further reduces the material of the cross-beam assembly.

The push frame 16 is particularly useful with the following crawler dozers of Deere & Company: 750J (standard), 850J (standard), 850J WT, and 850J LGP. It is to be understood that the push frame 16 could be used with a wide variety of crawler dozers. The bolts in the drawings and associated bolt-receiving holes are shown without their threads for simplification, the threads being understood.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A push frame for interconnecting an undercarriage of a tractor of a work vehicle and a blade of the work vehicle, the push frame comprising a first push-beam, a second push-beam, a first cross-beam, a second cross-beam, and a center joint, the first and second push-beams spaced apart to be positioned on laterally opposite sides of the undercarriage relative to a fore-aft axis of the push frame, the first and second cross-beams fixed respectively to the first and second push-beams laterally outwardly relative to the fore-aft axis and attached to one another laterally inwardly relative to the fore-aft axis by the center joint allowing relative movement between the first and second cross-beams, wherein each of the first and second cross-beams comprises a top wall, a bottom wall, a tractor-side wall, and a blade-side wall such that the top and bottom walls are fixed and angled relative to the tractor- and blade-side walls with the top and bottom walls spaced apart from one another and the tractor- and blade-side walls spaced apart from one another, each of the first and second cross-beams tapers in height between its top wall and its bottom wall as it extends along its width away from its tractor-side wall toward its blade-side wall, an end of each of the first and second cross-beams is greater in height at the tractor-side wall of that cross-beam than at the blade-side wall of that cross-beam.

2. The push frame of claim 1, wherein, with respect to each of the first and second cross-beams, the top wall slopes toward the bottom wall as the top wall extends along the width of that cross-beam.

3. The push frame of claim 2, wherein each of the top walls is inflected along its width.

4. The push frame of claim 3, wherein, with respect to each of the first and second cross-beams, the top wall comprises a first section attached to and extending from the tractor-side wall of that cross-beam, a second section attached to and extending from the blade-side wall of that cross-beam, and a bend between the first and second sections such that the second section slopes relative to the first section toward the blade-side wall.

5. The push frame of claim 1, wherein each of the first and second cross-beams tapers in height as it extends along its length laterally inwardly relative to the fore-aft axis.

6. The push frame of claim 5, wherein, with respect to each of the first and second cross-beams: the top and bottom walls interconnect the tractor- and blade-side walls, the top wall slopes toward the bottom wall as it extends along the width of that cross-beam away from the tractor-side wall toward the blade-side wall, and the top and bottom walls slope relative to the push-beam to which that cross-beam is fixed toward one another as they extend laterally inwardly relative to the fore-aft axis.

7. The push frame of claim 6, wherein the tractor-side wall and the blade-side wall extend toward one another as they extend along the length of the respective cross-beam laterally inwardly relative to the fore-aft axis.

8. The push frame of claim 5, wherein each of the first and second cross-beams tapers in width as it extends along its length laterally inwardly relative to the fore-aft axis.

9. The push frame of claim 1, wherein each of the first and second cross-beams tapers in width as it extends along its length laterally inwardly relative to the fore-aft axis.

10. The push frame of claim 1, wherein each of the first and second cross-beams is a hollow elongated structure with a non-rectangular cross-section.

11. A crawler dozer comprising a tractor, a blade, and the push frame of claim 1, the tractor comprising an undercarriage, wherein the first and second push-beams are pivotally attached to the tractor so as to be positioned laterally outwardly from the undercarriage on either side thereof respectively and are pivotally attached to the blade.

12. A push frame for interconnecting an undercarriage of a tractor of a work vehicle and a blade of the work vehicle, the push frame comprising a first push-beam, a second push-beam, a first cross-beam, and a second cross-beam, and a center joint, the first and second push-beams spaced apart to be positioned on laterally opposite sides of the undercarriage relative to a fore-aft axis of the push frame, the first and second cross-beams fixed respectively to the first and second push-beams laterally outwardly relative to the fore-aft axis and attached to one another laterally inwardly relative to the fore-aft axis by the center joint allowing relative movement between the first and second cross-beams, wherein each of the first and second cross-beams comprises a top wall, a bottom wall, a tractor-side wall, and a blade-side wall such that the top and bottom walls are fixed and angled relative to the tractor- and blade-side walls with the top and bottom walls spaced apart from one another and the tractor- and blade-side walls spaced apart from one another, each of the first and second cross-beams tapers in height between its top wall and its bottom wall as it extends along its length laterally inwardly relative to the fore-aft axis, each of the first and second cross-beams comprises a laterally outward end and a laterally inward end, and the height of that cross-beam is smaller at the laterally inward end than at the laterally outward end, and, with respect to each of the first and second cross-beams, the top wall of that cross-beam slopes downwardly from the laterally outward end to the laterally inward end and the bottom wall slopes upwardly from the laterally outward end to the laterally inward end.

13. A push frame for interconnecting an undercarriage of a tractor of a work vehicle and a blade of the work vehicle, the push frame comprising a first push-beam, a second push-beam, a first cross-beam, and a second cross-beam, and a center joint, the first and second push-beams spaced apart to be positioned on laterally opposite sides of the undercarriage relative to a fore-aft axis of the push frame, the first and second cross-beams fixed respectively to the first and second push-beams laterally outwardly relative to the fore-aft axis and attached to one another laterally inwardly relative to the fore-aft axis by the center joint allowing relative movement between the first and second cross-beams, wherein each of the first and second cross-beams comprises a top wall, a bottom wall, a tractor-side wall, and a blade-side wall such that the top and bottom walls are fixed and angled relative to the tractor- and blade-side walls with the top and bottom walls spaced apart from one another and the tractor- and blade-side walls spaced apart from one another, each of the first and second cross-beams tapers in height between its top wall and its bottom wall as it extends along its length laterally inwardly relative to the fore-aft axis, each of the first and second cross-beams comprises a laterally outward end and a laterally inward end, and the height of that cross-beam is smaller at the laterally inward end than at the laterally outward end, and, with respect to each of the first and second cross-beams, the top wall of that cross-beam slopes toward the bottom wall of that cross-beam as it extends from the laterally outward end to the laterally inward end.

14. A push frame for interconnecting an undercarriage of a tractor of a work vehicle and a blade of the work vehicle, the push frame comprising a first push-beam, a second push-beam, a first cross-beam, and a second cross-beam, and a center joint, the first and second push-beams spaced apart to be positioned on laterally opposite sides of the undercarriage relative to a fore-aft axis of the push frame, the first and second cross-beams fixed respectively to the first and second push-beams laterally outwardly relative to the fore-aft axis and attached to one another laterally inwardly relative to the fore-aft axis by the center joint allowing relative movement between the first and second cross-beams, wherein each of the first and second cross-beams comprises a top wall, a bottom wall, a tractor-side wall, and a blade-side wall such that the top and bottom walls are fixed and angled relative to the tractor- and blade-side walls with the top and bottom walls spaced apart from one another and the tractor- and blade-side walls spaced apart from one another, each of the first and second cross-beams tapers in height between its top wall and its bottom wall as it extends along its length laterally inwardly relative to the fore-aft axis, each of the first and second cross-beams comprises a laterally outward end and a laterally inward end, and the height of that cross-beam is smaller at the laterally inward end than at the laterally outward end, and, with respect to each of the first and second cross-beams, the bottom wall of that cross-beam slopes toward the top wall of that cross-beam as it extends from the laterally outward end to the laterally inward end.

* * * * *